US011415146B2

(12) United States Patent
Norwood et al.

(10) Patent No.: US 11,415,146 B2
(45) Date of Patent: Aug. 16, 2022

(54) CEILING FAN BLADE

(71) Applicant: Hunter Fan Company, Memphis, TN (US)

(72) Inventors: Bobby Neal Norwood, Oakland, TN (US); Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 16/660,144

(22) Filed: Oct. 22, 2019

(65) Prior Publication Data

US 2020/0224671 A1 Jul. 16, 2020

Related U.S. Application Data

(60) Provisional application No. 62/839,037, filed on Apr. 26, 2019, provisional application No. 62/792,432, filed on Jan. 15, 2019.

(51) Int. Cl.

| | |
|---|---|
| ***F04D 29/38*** | (2006.01) |
| ***F04D 25/08*** | (2006.01) |
| ***F01D 5/14*** | (2006.01) |

(52) U.S. Cl.

CPC ..... *F04D 29/384* (2013.01); *F01D 5/141* (2013.01); *F04D 25/088* (2013.01); *F05D 2240/301* (2013.01); *F05D 2240/303* (2013.01); *F05D 2240/304* (2013.01)

(58) Field of Classification Search

CPC ..... F04D 29/384; F04D 25/088; F01D 5/141; F05D 2240/301; F05D 2240/304; F05D 2240/303; F05D 2250/14; F05D 2250/16; F05D 2250/17

See application file for complete search history.

(56) References Cited

U.S. PATENT DOCUMENTS

| | | | |
|---|---|---|---|
| 2,918,977 | A | 12/1959 | Fedan et al. |
| 6,039,541 | A | 3/2000 | Parker et al. |
| 6,146,097 | A | 11/2000 | Bradt |

(Continued)

FOREIGN PATENT DOCUMENTS

| | | | |
|---|---|---|---|
| CN | 2886147 | Y | 4/2007 |
| CN | 2886148 | Y | 4/2007 |

(Continued)

OTHER PUBLICATIONS

Home Depot, "Draper 54 in. Outdoor LED Brushed Nickel Ceiling Fan with Remote Control By Home Decorators Collection", https://www.homedepot.com/p/Home-Decorators-Collection-Draper-54-in-Outdoor-LED-Brushed-Nickel-Ceiling-Fan-with-Remote-Control-YG664-BN/305363983, 5 pages, US.

(Continued)

*Primary Examiner* — Jacob M Amick
*Assistant Examiner* — Charles J Brauch
(74) *Attorney, Agent, or Firm* — McGarry Bair PC

(57) ABSTRACT

A ceiling fan or similar air-moving device can include a motor for rotating one or more blades to drive a volume of air about a space. The blade can include a body having an outer surface with a flat top surface and a flat bottom surface, and a side edge. A curved transition can extend between one of the flat top surface or the flat bottom surface, and the side edge. The curved transition can include an elliptical curvature.

20 Claims, 5 Drawing Sheets

(56) References Cited

U.S. PATENT DOCUMENTS

| | | | | |
|---|---|---|---|---|
| D594,551 | S | 6/2009 | Parker et al. | |
| D597,198 | S | 7/2009 | Parker et al. | |
| 7,665,967 | B1 * | 2/2010 | Parker | F04D 29/38 416/223 R |
| D615,183 | S | 5/2010 | Parker et al. | |
| 7,927,071 | B2 | 4/2011 | Parker et al. | |
| D712,533 | S | 9/2014 | Allen et al. | |
| D801,516 | S | 10/2017 | Wang | |
| D804,648 | S | 12/2017 | McRoberts | |
| 9,982,679 | B2 | 5/2018 | Santolucito et al. | |
| 10,995,769 | B2 | 5/2021 | Norwood et al. | |
| 2003/0190234 | A1 | 10/2003 | Huang | |
| 2007/0122286 | A1 | 5/2007 | Leung et al. | |
| 2009/0263254 | A1 * | 10/2009 | Bucher | F04D 29/023 416/229 R |
| 2010/0054947 | A1 * | 3/2010 | Chen | F04D 29/38 416/223 R |

FOREIGN PATENT DOCUMENTS

| | | | |
|---|---|---|---|
| CN | 2929281 | Y | 8/2007 |
| CN | 206845504 | U | 1/2018 |
| CN | 111434928 | A | 7/2020 |

OTHER PUBLICATIONS

Chinese Patent Office, Office Action re Corresponding Application No. 202010334031.6, dated Oct. 25, 2021, 12 pages, China.

Chinese Patent Office, Office Action re Corresponding Application No. 202010334031.6, dated May 19, 2022, 11 pages, China.

* cited by examiner

CEILING FAN BLADE

CROSS REFERENCE TO RELATED APPLICATIONS

This application claims the benefit of U.S. Provisional Patent Application No. 62/839,037 filed Apr. 26, 2019, and U.S. Provisional Patent Application No. 62/792,432 filed Jan. 15, 2019, the entireties of which are incorporated herein.

BACKGROUND

Ceiling fans are machines typically suspended from a structure for moving a volume of air about an area. The ceiling fan includes a motor, with a rotor and stator, suspended from and electrically coupled to the structure. A set of blades mount to the rotor such that the blades are rotatably driven by the rotor and can be provided at an angled orientation to move a volume of air about the area. As the cost of energy becomes increasingly important, there is a need to improve the efficiency at which the ceiling fans operate.

BRIEF DESCRIPTION

In one aspect, the disclosure relates to a blade for a ceiling fan having a fan motor for rotating the blade. The blade includes a body having an outer surface extending between a root and a tip in a span-wise direction, and extending between a first side edge and a second side edge in a chord-wise direction. The outer surface has a top surface and a bottom surface, and a curved transition on the top surface having a curvature extending to the first side edge or the second side edge, the curved transition having a greater chordwise length than any transition on the bottom surface.

In another aspect, the disclosure relates to a blade for a ceiling fan, the blade having a chordwise direction. The blade includes a flat upper surface and a flat lower surface opposite from the flat upper surface. A side edge having a width spaces the flat upper surface from the flat lower surface. A first curved transition transitions between the side edge and the flat upper surface, and has a chordwise width greater than any transition between the flat lower surface and the side edge.

DETAILED DESCRIPTION

Figure 1:
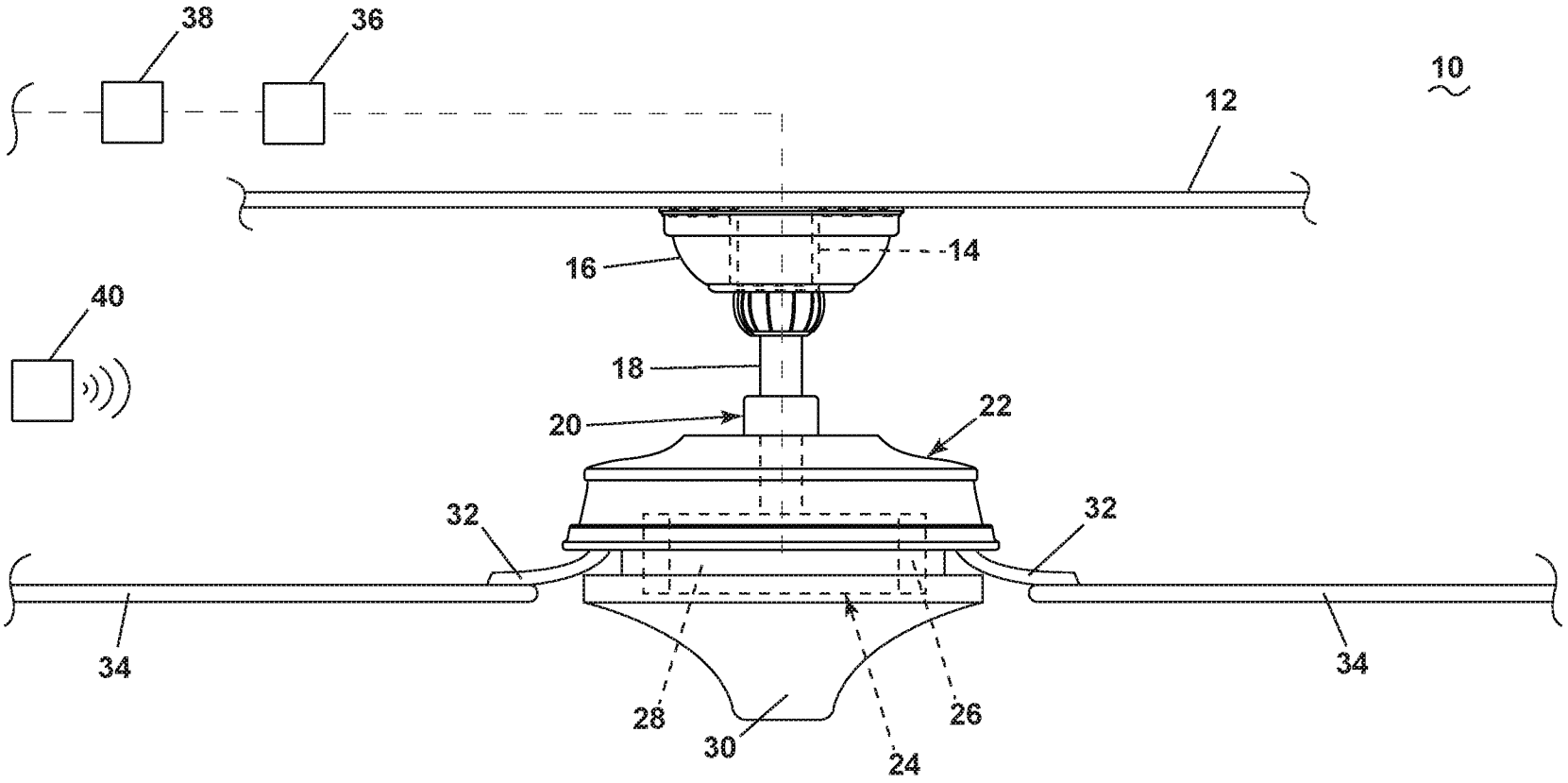
FIG. 1 is a schematic view of a structure with a ceiling fan suspended from a structure and including a set of blades.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of fluid such as air. The blades 34 can be operably coupled to the motor 24 at the rotor 26, such as via the blade irons 32. The blades 34 can include a set of blades 34, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 36 and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 38 can be electrically coupled to the electrical supply 36 to control operation of the ceiling fan 10 via the electrical supply 36. Alternatively, the controller 38 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 40, alone or in addition to the wired controller 38, can be communicatively coupled to a controller or a wireless receiver in the ceiling fan 10 to control operation of the ceiling fan 10. It is further contemplated in one alternative example that the ceiling fan be operated by the wireless controller 40 alone, and is not operably coupled with the wired controller 38.

Figure 2:
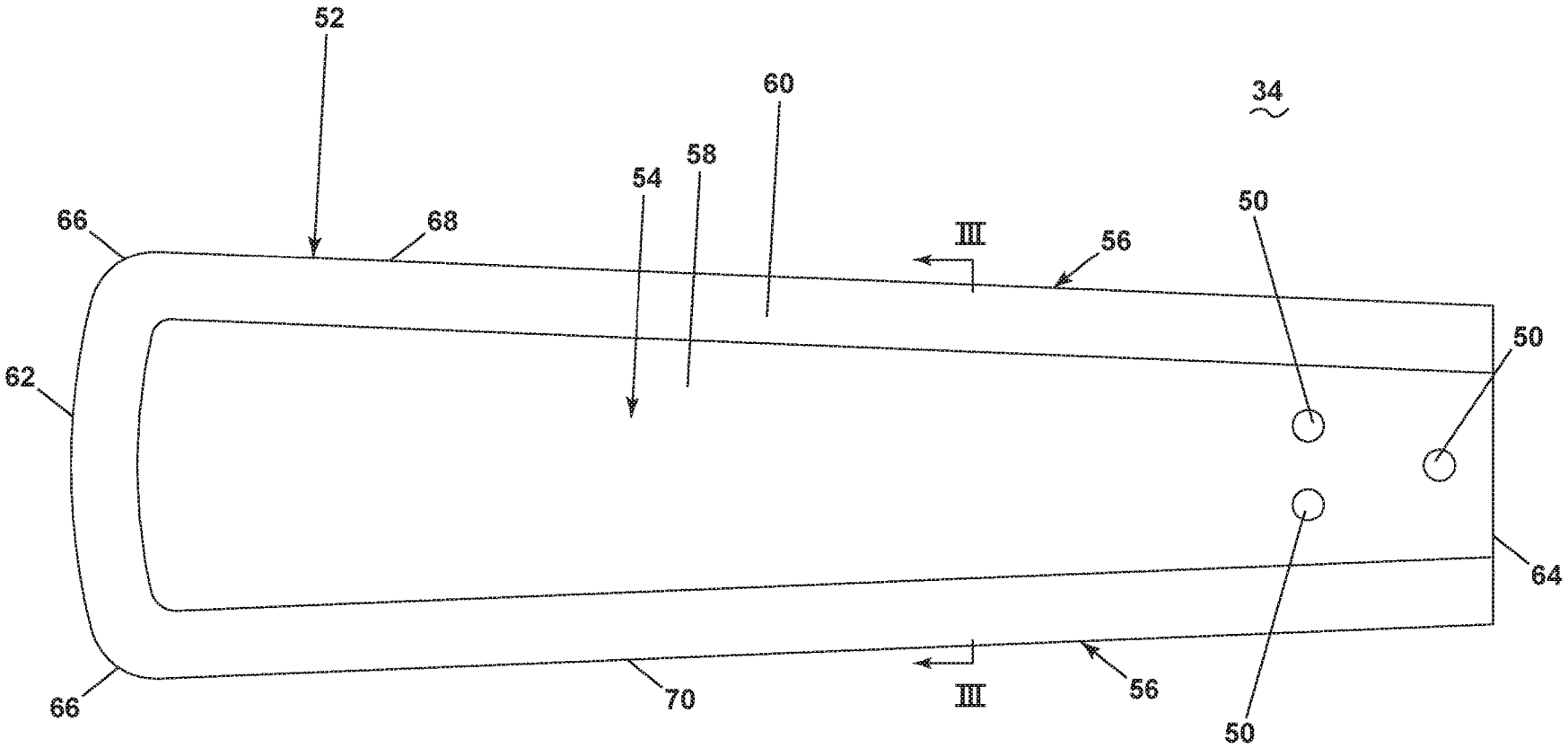
FIG. 2 is a top view of one blade from the set of blades of FIG. 1 having a curved surface transitioning to an edge of the blades.

Referring to FIG. 2, one blade 34 is isolated from the remainder of the fan 10 of FIG. 1 for illustration. Three fastener apertures 50 are provided in the blade 34 for fastening the blade to the motor 24 for rotating the blade 34 about the fan 10, preferably via a blade iron 32. Any number of fastener apertures or indeed any blade-attachment method or mechanism is within the scope of this disclosure. The blade 34 includes an outer surface 52 including a top surface 54. The top surface 54 terminates at a side edge 56. The top surface 54 can include a flat portion 58 and a top curved transition 60 transitioning from the flat portion 58 to the side edge 56. Alternatively, the top surface need not be flat, but can include alternative geometries extending to the curved transition 60. In one example, the curved transition 60 can be about one inch from the top surface 58 to the side edge 56, while any width is contemplated. In another example, the curved transition 60 can extend between 5%-40% of the chord-wise width of the blade between the opposing side edges 56, while distances less than 5% or greater than 40% are contemplated.

The blade 34 further includes a tip 62 and a root 64, with the root 64 adjacent the fastener aperture 50 and the tip 62 opposite the root 64. Curved corners 66 transition between the tip 62 and the side edges 56, while it should be appreciated that the curved corners 66 can be optional or can include other shapes, such as sharp corners, for example. A chord-wise direction can be defined between the opposing side edges 56 and a span-wise direction can be defined between the tip 62 and the root 64. The blade 34 can widen extending from the root to the tip in the span-wise direction, defined in the chord-wise direction, while any top-down shape for the blade is contemplated, such as having a thinning chord-wise width defined in the span-wise direction extending outwardly. Non-limiting examples of blade shapes can include squared, rectangular, curved, angled, or rounded.

Furthermore, the blade 34 can include a first edge 68 and a second edge 70 as the side edge 56, which can be arranged as a leading edge and a trailing edge, respectively, while the particular arrangement can vary based upon a rotational direction of the blade. The chord-wise direction can thus be defined between the first edge 68 and the second edge 70, defining a blade chord. As is appreciable, the blade chord as illustrated increases from the root 64 toward the tip 62.

Further still, the curved transition 60 can extend along the entirety of the first edge 68, the second edge 70, the tip 62, and/or the root 64. As shown, the curved transition 60 extends along the first and second edges 68, 70 and the tip 62, curving at the corners 66 where the side edges 68, 70 meet the tip 62.

Figure 3:
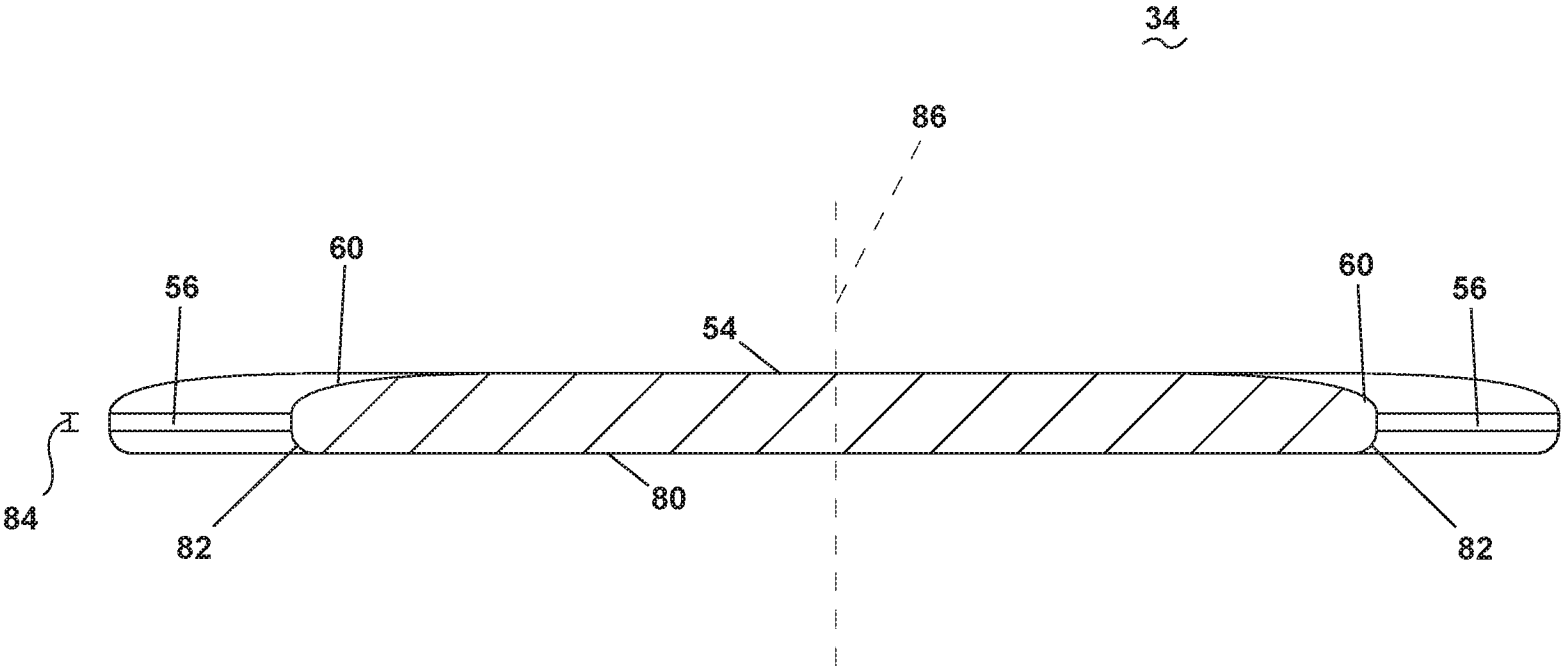
FIG. 3 is a sectional view of the blade of FIG. 2 illustrating the curved transition to the edge of the blades on a top surface and a bottom surface.

Referring to FIG. 3, taken across the section III-III of FIG. 2, the blade 34 further includes a bottom surface 80 that may or may not have a flat or planar portion, and a bottom curved transition 82 transitioning from the bottom surface 80 to the side edge 56. The side edge 56 includes a width 84 to define a distance spacing the curved transition 60 at the top surface 54 from the curved transition 82 of the bottom surface 80. In one additional example, the width 84 can be zero, such that the curved transition 60 from the top surface 54 transitions immediately to the curved transition 82 of the bottom surface 80. The blade 34 can be symmetric about a centerline 86, while it is contemplated that the blade 34 can be non-symmetric, can be curved, or can include other shapes and should not be limited to the symmetric shape as shown.

Furthermore, it should be appreciated that the blade 34 can be mounted at an angle of attack. The angle of attack can be defined based upon an angular position of the blade 34, such that the bottom surface 80 and the top surface 54 are arranged at an angle relative to the horizontal, or to a surface from which the ceiling fan hangs or suspends above. The angle of attack permits the blade 34 to drive a volume of air, pushing the air in an upward or downward direction based upon the angle and the direction of movement of the blade 34. Without the angle of attack, the air movement generated by the blade 34 would be minimal.

Figure 4:
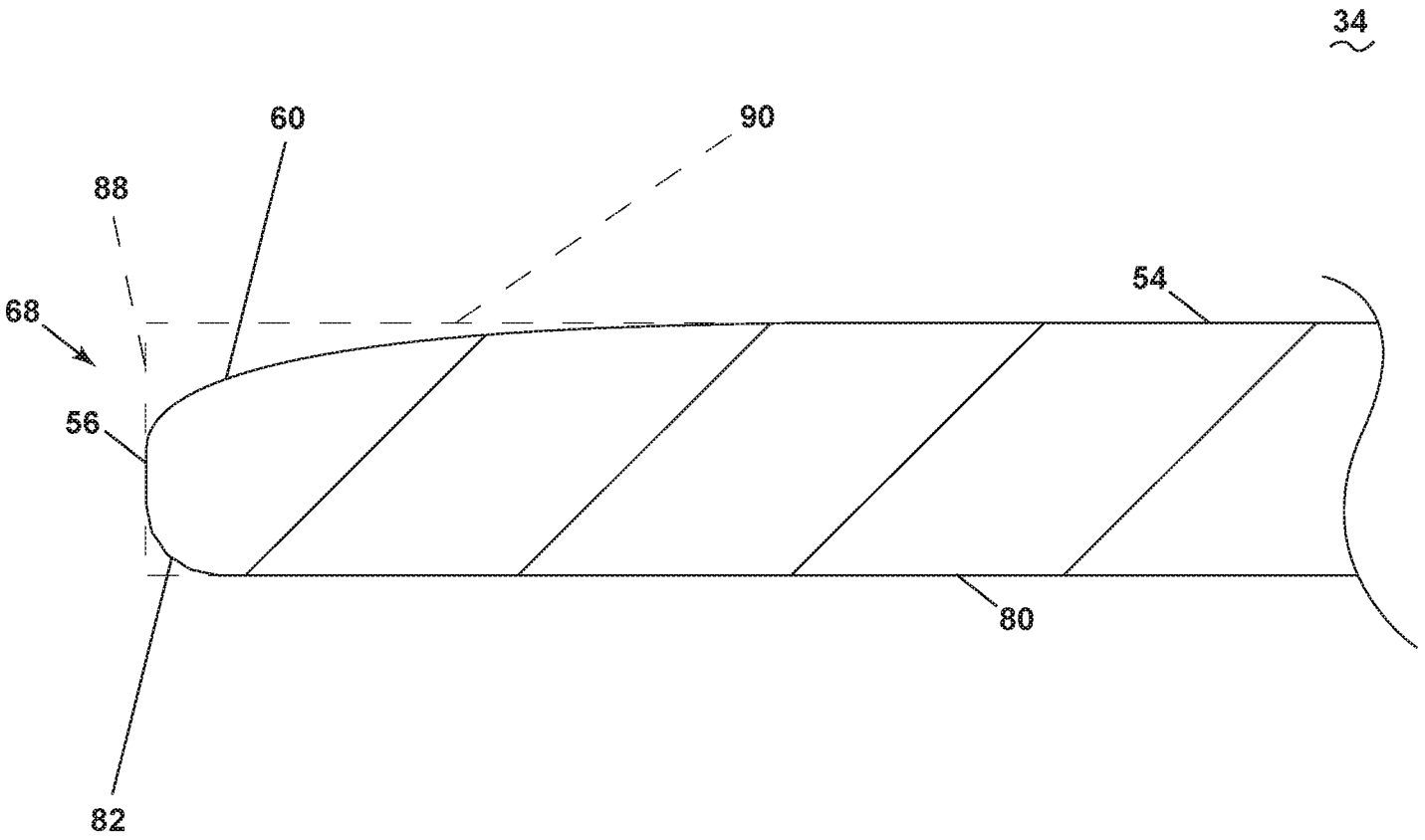
FIG. 4 is an enlarged sectional view of one edge of the blade of FIG. 3, illustrating an elliptical curved surface of the blades.

Referring now to FIG. 4, an enlarged section view of the first edge 68 of the blade 34 better shows the curvature of the curved transitions 60, 82. The curved transitions 60, 82 can provide for transitioning between the top and bottom surfaces 54, 80, to the side edge 56 arranged perpendicular to the top and bottom surfaces 54, 80. One or both of the curved transitions 60, 82 can be specifically shaped as having an elliptical arc, defining at least a portion of an elliptical profile for the curved transitions 60, 82. More specifically, one or more of the curved transitions can be represented by equation (1) written in standard form:

$$\frac{x^2}{a^2} + \frac{y^2}{b^2} = 1 \tag{1}$$

where x represents an x-axis 90 and y represents a y-axis 88 in Cartesian coordinates. The x-axis 90 can be defined in the direction extending from the top surface 54 to the bottom surface 80, and the y-axis 88 can be defined in the chord-wise direction. Furthermore, a represents a length for the ellipse respective of the x-axis, and b represents a length for the ellipse respective of the y-axis. It should also be appreciated that where a=b, the ellipse can be a circle, defining no major or minor axis, as the diameters for a circle are equal. Additionally, all other ellipses can be non-circular, where a does not equal b, defining major and minor axes as the greatest and least diameters, respectively. Thus, it is contemplated that the curved transitions 60, 82 can define an elliptical shape, a non-circular elliptical shape, a parabolic shape, or a hyperbolic shape.

In FIG. 4, the curved transition 60 from the top surface 54 to the side edge 56 can be represented by equation (2) below, for example:

$$\frac{x^2}{6^2} + \frac{y^2}{1^2} = 1 \tag{2}$$

where a=6 and b=1. Furthermore, the curved transition 82 from the side edge 56 to the bottom surface 80 can be 90-degrees of a circular ellipse, represented by equation (3) below, for example:

$$\frac{x^2}{2^2} + \frac{y^2}{2^2} = 1 \tag{3}$$

where a=2 and b=2. It should be appreciated that while the curved transition 82 at the bottom surface 80 is shown as an ellipse having an equal major and minor axis forming a circle, it can alternatively be an ellipse having unequal major and minor axes. Furthermore, the specific equations representing the curved transitions 60, 82 can be any suitable elliptical arc, and should not be limited by the specific arcs defined by equations (2) and (3) above.

In an example where one of the curved transitions 60, 82 is parabolic, an equation representing at least a portion of the curvature of the curved transition 60, 82 can be represented in standard form as:

$$(x-h)^2=4p(y-k) \tag{4}$$

where the focus can be defined as (h, k+p) and the directrix is defined as y=k−p. x can represent the x-axis 90 and y can represent the y-axis 88.

In another examples, where one of the curved transitions 60, 82 is hyperbolic, an equation representing at least a portion of the curvature of the curved transition 60, 82 can be represented in standard form as:

$$\frac{(x-h)^2}{a^2}-\frac{(y-k)^2}{b^2}=1 \tag{5}$$

or $$\frac{(y-k)^2}{a^2}-\frac{(x-h)^2}{b^2}=1 \tag{6}$$

where equation (5) is based upon a horizontal transverse axis and equation (6) is based on a vertical transverse axis, which ultimately depends on the local coordinate system defining the curved transitions 60, 82 of the blade 34. (h, k) can be used to define a center for the hyperbola, while x can represent the x-axis 90 and y can represent the y-axis 88.

The curved transition 60 at the top surface 54 can have a greater chord-wise extent from the side edge 56 than that of any curved transition 82 at the bottom surface 80, as can be appreciable as illustrated by the broken lines 88, 90 in FIG. 4. Such a greater chord-wise extent can be defined by a greater major axis for the elliptical curvature of the curved transition 60 at the top surface 54, for example. Furthermore, it should be appreciated that while shown as having both curved transitions 60, 82, it is contemplated that the blade 34 only include one curved transition 60, with a corner or edge replacing the second curved transition 82, for example, such as along the broken lines at either curved transition 60, 82. In other words the transition 82 at the bottom surface can be a sharp corner with little to no radius.

It should be appreciated that one or more curved transitions 60, 82 between the top surface 54 and the bottom surfaces 80, and the side edge 56 can provide for increased efficiency for the blade 34. As both the first edge 68 and the second edge 70 can include the curved transitions 60, 82, such an efficiency gain can be appreciated in either rotational direction of the blade 34. Furthermore, the elliptical geometry for the one or more curved transitions 60, 82 can provide for improved efficiency for the blades 34, as compared to a blade without a curved transition, especially the transition 60 on the top surface 54.

It should be further appreciated that additional geometries for the curved transition 60 are contemplated, such as that of a root function or a logarithmic function. For example, the curved transition 60 can be represented as a nth root function as:

$$f(x)=\sqrt[n]{x} \tag{7}$$

or $$y=x^{1/n} \tag{8}$$

where x represents a value for the x-axis, and f(x) and y represent a value for the y-axis, and n represents any real number. As such, the nth root function can be a square root function, or a cubic root function, or any variation thereof. Additionally, the curved transition 60 can be represented as a logarithmic equation as:

$$y=\log_b(x) \tag{9}$$

where b is the logarithmic base, x represents the value for the x-axis, and y represents the value for the y-axis.

Further still, it should be understood that a combination of different curved transitions 60 can be used for a single blade. For example, a first curved transition 60 can be used for a leading edge and a different curved transition can be used for a trailing edge. In another example, a first curved transition 60 can be used for the curved transition at the top surface 54, and a different second curved transition 82 can be used at the bottom surface 80. In yet another example, the curved transition 60 can vary along the leading edge, trailing edge, upper surface, lower surface, or otherwise in the span-wise direction between the root and the tip. Therefore, it should be appreciated that a myriad of different curved transitions can be utilized with a fan blade, which can provide for further increasing efficiency, as well as being utilized in either rotational direction.

Figure 5A:
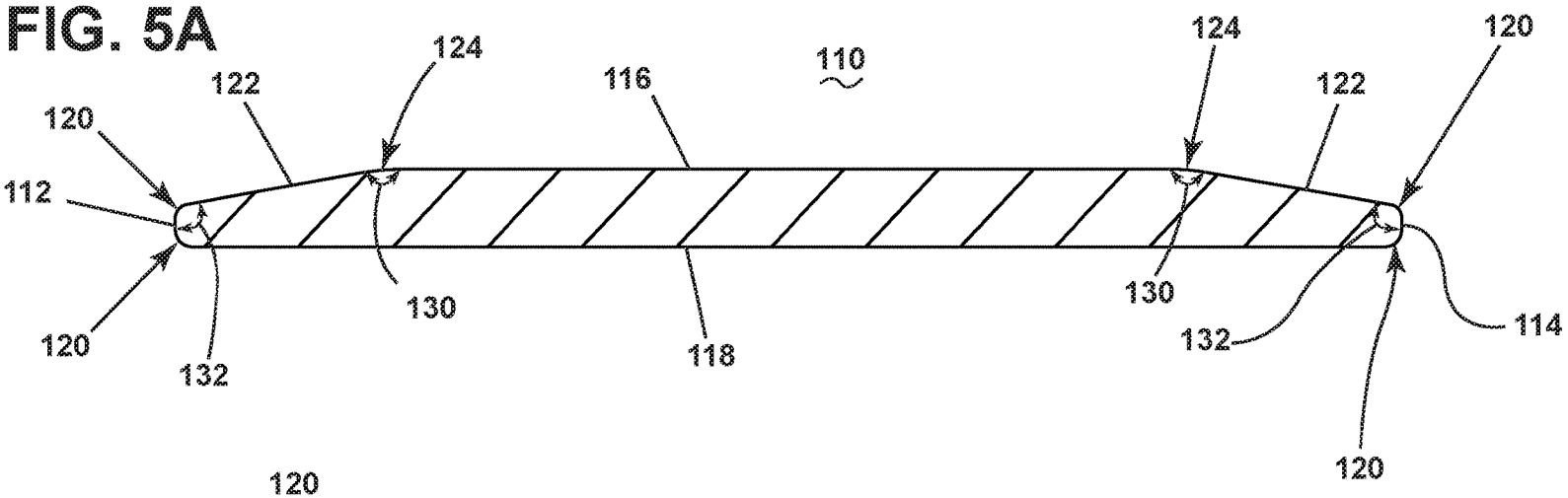
FIG. 5A is a sectional view of another exemplary blade illustrating a chamfered surface taken across section VA-VA of FIG. 5B.
Figure 5B:
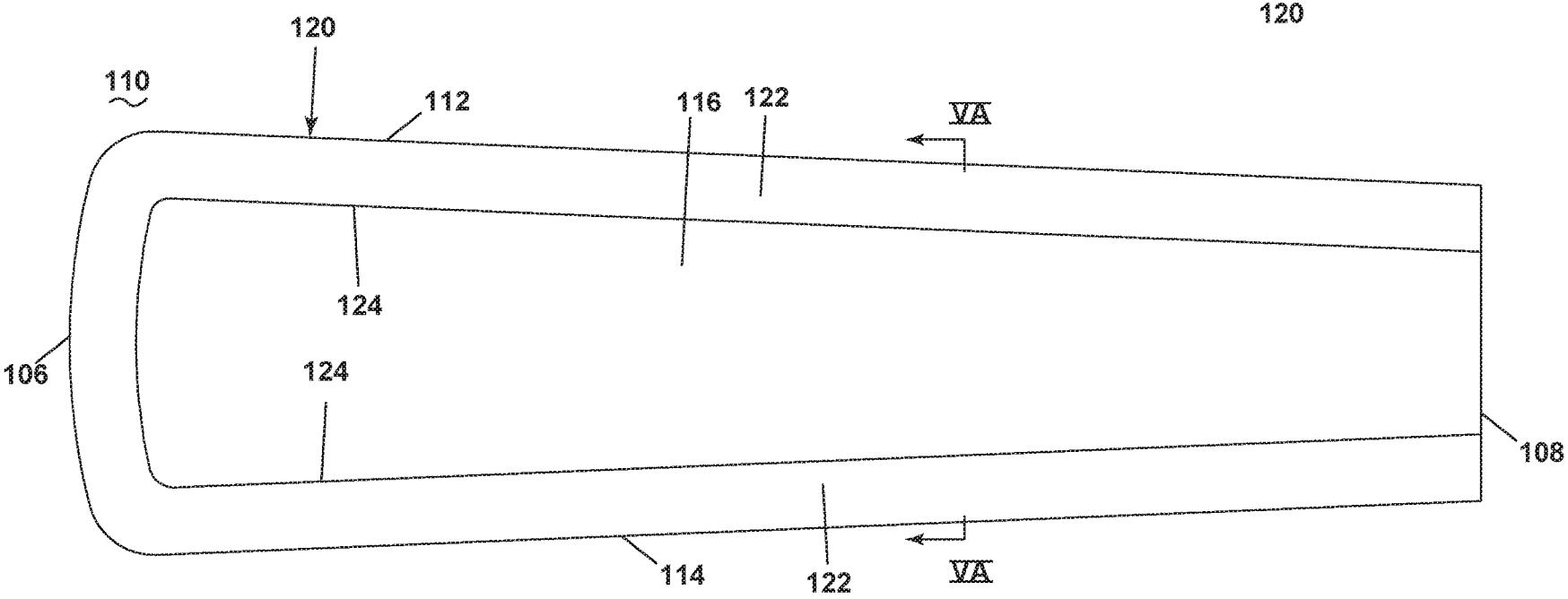
FIG. 5B is a top-down view of the blade of FIG. 5A including the chamfered surface extending along a leading edge, a trailing edge, and a tip of the blade.

Referring now to FIGS. 5A and 5B, another blade 110 is shown in cross-sectional profile and top view, respectively. The blade 110 can include a root 108 and a tip 106, and can have a top-down shape substantially similar to that as shown in the top-down view of FIG. 2, for example, while other variations in top-down shape are contemplated. The blade 110 can include a leading edge 112 and a trailing edge 114, along with a top surface 116 and a bottom surface 118. Each of the leading edge 112 and the trailing edge 114 can include a radiused or rounded transition 120 between the top surface 116 and the bottom surface 118.

The blade 110 can include at least one chamfered edge 122 transitioning between the top surface 116 and one of the leading edge 112 or the trailing edge 114. As shown, the chamfered edge 122 is provided at both the leading edge 112 and the trailing edge 114. In one example, the chamfered edge 122 can extend around the blade 110 continuously along the leading edge 112, the tip, and the trailing edge 114, while it is contemplated that any of, or one or more portions of the root, the tip, the leading edge 112, and the trailing edge 114 includes the chamfered edge 122. The chamfered edge 122 can meet the leading edge 112 and the trailing edge 114 at the rounded transition 120. Similarly, a radiused or rounded transition 124 can be provided at the junction between the top surface 116 and the chamfered edge 122.

In one example, the chamfered edge 122 can be between 5% and 40% of the chord-wise width of the blade, measured extending between the leading edge 112 and the trailing edge 114. The chamfered edge 122 can be arranged at an angle 130 relative to the top surface 116 less than 180-degrees, but greater than 90-degrees. In one example, the angle 130 can be between 175-degrees and 155-degrees.

Additionally, the chamfered edge 122 can be arranged at an angle 132 relative to the leading edge 112 or the trailing edge 114. The angle 132 can be greater than 90-degrees. In one example, the angle can be between 95-degrees and 115-degrees. In one additional alternative example, the chamfered edge 122 can be radiused, such as concave or convex.

Additionally, the height of chamfered edge 122 can be such that the thickness of the leading edge 112 or the trailing edge 114 meets regulatory requirements. As such, the thickness between the top surface 116 and the bottom surface 118 will necessarily be thicker than that of the leading edge 112 or the trailing edge 114 having the chamfered edge 122. Furthermore, the rounded transitions 120 can be the minimum regulatory required rounded edge meeting the leading edge 112 or the trailing edge 114. In one example, the leading edge 112 or the trailing edge 114 can be flat, perpendicular to the top surface 116 and the bottom surface 118, with the rounded transitions connecting the leading and trailing edges 112, 114 to the top and bottom surfaces 116, 118. Alternatively, it is contemplated that the leading and trailing edge 112, 114 are wholly radiused.

The blade 110 including the chamfered edge 122 provides for improved blade efficiency and aerodynamic performance. Such as blade 110 can require lesser energy per unit volume of air moved, thereby improving overall efficiency of the fan. Furthermore, the flat bottom surface provides for a traditional aesthetic for the fan blade that consumers find appealing. Thus, efficiency can be improved without sacrificing visual appeal of the ceiling fan or blades themselves.

The blades and sections thereof as described herein provide for both increased total flow volume for a ceiling fan, resulting in increased efficiency, while maintaining the aesthetic appearance having an unadorned bottom surface of a ceiling fan that consumers desire. More specifically, the curved transitions 60, 82 provide for increased downward force on air which increases the total volume of airflow, while the flat upper and lower surfaces of the blade match traditional fan blade styles, providing a pleasing or appealing user aesthetic.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blade for a ceiling fan having a fan motor for rotating the blade, the blade comprising:

a body having an outer surface extending between a root and a tip in a span-wise direction and extending between a first side edge and a second side edge in a chord-wise direction, the outer surface having a planar top surface and a bottom surface, with the first side edge and the second side edge spacing the planar top surface from the bottom surface;

a top curved transition transitioning from the planar top surface to the first side edge; and a bottom curved transition transitioning from the planar top surface to one of the first side edge or the second side edge;

wherein the top curved transition has a greater chordwise length than the bottom curved transition.

2. The blade of claim 1 wherein the at least one curved transition is a first transition extending to the first side edge and further comprising a second transition between the first side edge and a flat lower portion.

3. The blade of claim 2 wherein the first and second transitions each include an elliptical curvature wherein a major axis for the elliptical curvature of the first transition is greater than a major axis for the elliptical curvature of the second transition.

4. The blade of claim 1 wherein the curvature defines a non-circular profile.

5. The blade of claim 1 wherein the at least one curved transition includes a first transition at a junction of the first side edge and a flat upper portion, and a second transition at a junction of the second side edge and the flat upper surface, and the blade includes a third transition at a junction of the first side edge and a flat lower surface, and a fourth transition at a junction of the second side edge and the flat lower surface.

6. The blade of claim 1 wherein the curvature is one of elliptical, hyperbolic, parabolic, an nth root curvature, a logarithmic curvature, or a combination thereof.

7. The blade of claim 6 wherein the curvature is elliptical having a major axis that extends in the chord-wise direction.

8. The blade of claim 6 wherein the curvature is elliptical having and a minor axis that is parallel to one of the first side edge or the second side edge.

9. The blade of claim 1 wherein the at least one curved transition is about 1 inch wide defined in the chord-wise direction.

10. The blade of claim 1 wherein the at least one curved transition extends between 5% and 40% of the chord-wise width between the first side edge and the second side edge.

11. The blade of claim 1 wherein the at least one transition extends along the first side edge and the second side edge to the tip and along an entirety of the tip.

12. The blade of claim 1 wherein the transition extends along an entirety of the first side edge.

13. A blade for a ceiling fan, the blade having a chordwise direction and comprising:

a flat, planar upper surface;

a flat, planar lower surface opposite from the flat, planar upper surface;

a side edge having a width spacing the flat, planar upper surface and the flat, planar lower surface;

a first curved transition transitioning between the side edge and the flat, planar upper surface; and a second curved transition transitioning between the side edge and the flat, planar lower surface;

wherein first curved transition has a chordwise width greater than the chordwise width of the second curved transition.

14. The blade of claim 13 wherein the first curved transition has a curvature that is one of elliptical, hyperbolic, parabolic, an nth root curvature, a logarithmic curvature, or a combination thereof.

15. The blade of claim 14 wherein the first curved transition includes the elliptical curvature.

16. The blade of claim 15 wherein the elliptical curvature does not define a circular profile.

17. The blade of claim 13 further comprising a second curved transition between the side edge and the flat, planar lower surface.

18. The blade of claim 17 wherein the second curved transition has a curvature that is one of elliptical, hyperbolic, parabolic, an nth root curvature, a logarithmic curvature, or a combination thereof.

19. The blade of claim 18 wherein the first curved transition is wider than the second curved transition defined in a chord-wise direction between the side edge and an opposing side edge of the blade.

20. The blade of claim 13 wherein the first curved transition extends around a periphery of the blade.

* * * * *